US008096900B2

(12) United States Patent
Håseth

(10) Patent No.: US 8,096,900 B2
(45) Date of Patent: Jan. 17, 2012

(54) MAT FOR SPORT AND GAMES

(75) Inventor: Anders Håseth, Oslo (NO)

(73) Assignee: Sports Innovation AS, Oslo (NO)

( * ) Notice: Subject to any disclaimer, the term of this patent is extended or adjusted under 35 U.S.C. 154(b) by 1120 days.

(21) Appl. No.: 10/593,140

(22) PCT Filed: Mar. 19, 2004

(86) PCT No.: PCT/NO2004/000078

§ 371 (c)(1),
(2), (4) Date: Sep. 27, 2006

(87) PCT Pub. No.: WO2005/089888

PCT Pub. Date: Sep. 29, 2005

(65) Prior Publication Data

US 2008/0200285 A1 Aug. 21, 2008

(51) Int. Cl.
*A63B 67/20* (2006.01)

(52) U.S. Cl. ..... 473/422; 473/421; 473/425; 463/31

(58) Field of Classification Search ..... 473/422, 473/421, 425; 463/31

See application file for complete search history.

(56) References Cited

U.S. PATENT DOCUMENTS

| | | | | |
|---|---|---|---|---|
| 4,659,090 | A * | 4/1987 | Kustanovich | 273/376 |
| 6,454,652 | B2 * | 9/2002 | Miyamoto et al. | 463/31 |
| 6,761,315 | B2 * | 7/2004 | Kato et al. | 235/462.45 |
| 2002/0020749 | A1 * | 2/2002 | Kato et al. | 235/462.45 |
| 2003/0062675 | A1 * | 4/2003 | Noro et al. | 273/237 |

FOREIGN PATENT DOCUMENTS

| | | | |
|---|---|---|---|
| DE | 29 32 100 | | 2/1981 |
| DE | 285 658 | | 12/1990 |
| DE | 4117374 | | 12/1992 |
| DE | 10137420 | | 2/2003 |
| GB | 2 323 297 | | 9/1998 |
| GB | 2323297 | * | 9/1998 |
| WO | WO 86/05108 | | 9/1986 |

* cited by examiner

*Primary Examiner* — Pierre Eddy Elisca
*Assistant Examiner* — Shahid Kamal
(74) *Attorney, Agent, or Firm* — Cozen O'Connor

(57) ABSTRACT

Mat for sport and games for detecting impact position of a movable object. The mat includes an outer layer and an inner layer, each with inlays of electrically conductive elements forming a pressure-sensitive switch distributed over the target area. The pressure sensitive switches communicate with electronic circuits for indicting, processing and presentation of electrical signals when the switches are activated by a ball impact.

32 Claims, 9 Drawing Sheets

MAT FOR SPORT AND GAMES

CROSS-REFERENCE TO RELATED APPLICATION

Figure 1:
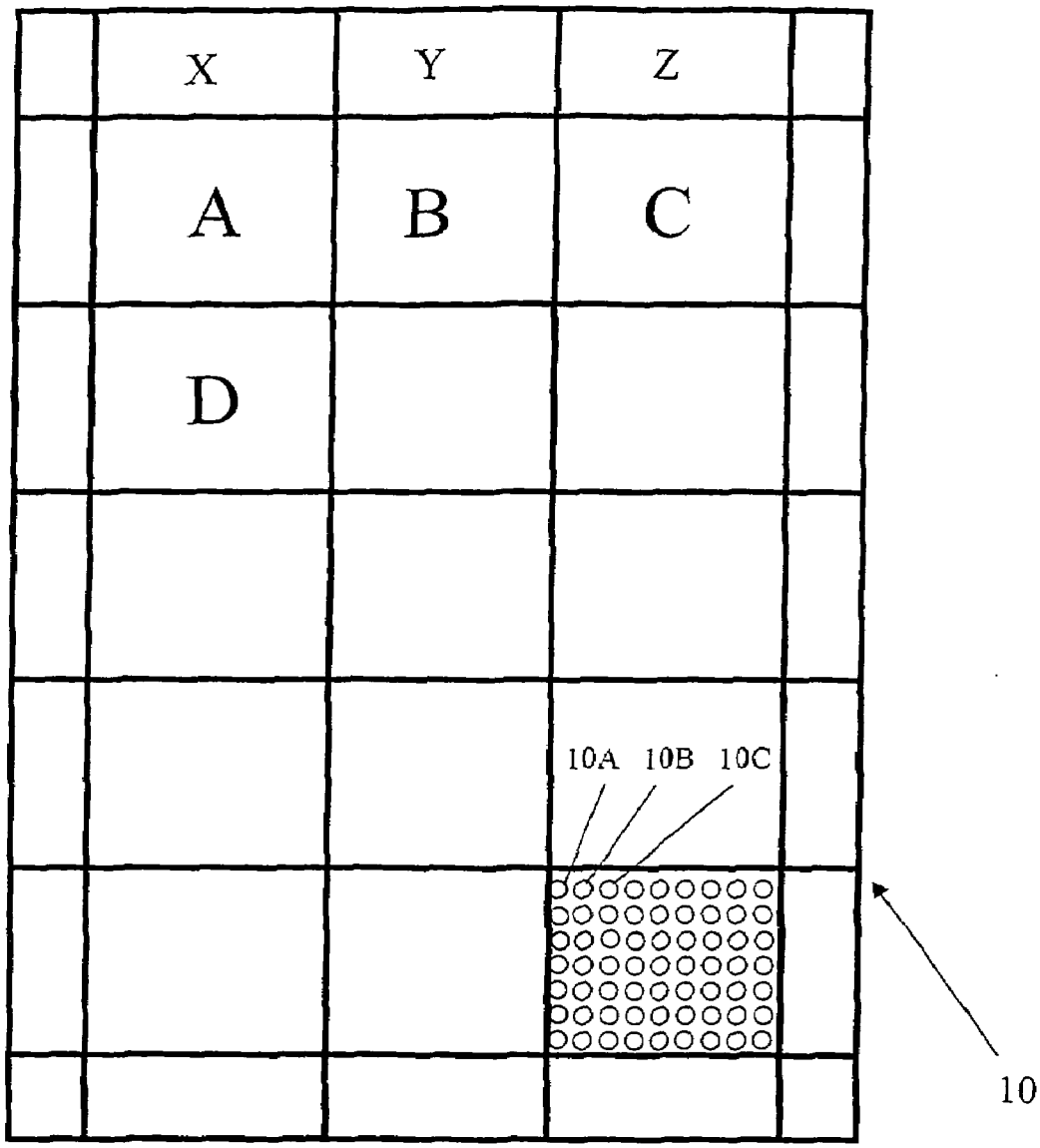

This is a U.S. national stage of application No. PCT/NO2004/000078, filed on 19 Mar. 2004, the content of which is incorporated here by reference.

During a long time there has been a need or interest in sports and games for detecting the position of impact and/or success rate of a moveable object, such as a ball. Typically in baseball, tennis and other ball games or sports, various attempts have been made to devise systems or methods for detecting object touchdown/impact or hit point, in particular in relation to boundary lines of the sport court or field.

More specifically serving in tennis and pitching in baseball are both activities demanding a high degree of precision. As a result, athletes training in these skills are required to do a lot of repetitive precision training. Unfortunately, there are no tools on the market today to actually measure the degree of precision during training. Evaluation of the athlete's success during training is entirely subjective, dependant on the visual judgement of an independent observer, a coach or a fellow athlete, or the training athlete himself. With the speed of the ball travelling at up to 135 mph (around 217 km/h) in tennis and up to 90 mph (around 145 km/h) in baseball, it is extremely difficult, even impossible, to give a good visual evaluation of any serve or pitch. In addition, it goes without saying that serving 100 balls in the same corner or pitching 50 similar balls without getting any objective feedback on the hit point and/or the rate of success can be very tedious indeed.

The present invention is directed to an improved apparatus for such purposes, in particular for use when training or practising specific hits or shots, but also for use in competitions. Examples of uses other than for ball sports and games, may be where other types of objects, such as player's feet, are to be detected in permitted or not permitted positions during the play. This may be the case in hand ball or in long jump competitions.

In connection with tennis numerous proposals have been set forth for automatic tennis court line calling/judgment, to detect whether the ball lands in or out of a tennis court play area. Thus, U.S. Pat. No. 4,859,986 describes a system for determining whether an electrically conductive ball touches down in bounds or out of bounds on a playing surface. This system has drawbacks in that the ball has to be electrically conductive.

Other examples of methods and apparatus for detecting impact of the ball along the boundary lines of the tennis court or other sport courts or fields, are to be found in U.S. Pat. Nos. 4,855,711 and 5,954,599. These known methods are accordingly intended for use during the play, in particular for aiding the referee or the players in order to avoid discussions as to whether or not the ball lands in or out in relation to the various boundary lines.

A further example is to be found in U.S. Pat. No. 4,990,897 that relates to a method and an apparatus for detecting and for recognizing impacts by measuring changes in electrical impedance. Thus, this patent specification is directed to the type of sensor employed in connection with an external electronic system for application, inter alia in sports, whenever there is a need to detect whether a ball strikes on or outside a given line, such as in tennis, while avoiding disturbances due to other types of impact, such as those from the feet of the player.

Also U.S. Pat. No. 4,365,805 relates to a system for aiding a person in determining whether a ball has struck one of a plurality of boundary lines for a playing court, such as a tennis court. A plurality of laminated, pressure sensitive, contact type switches extend along the boundary lines of the court, with digital circuitry connected to these switches for repeatedly examining the status of the switches and thus providing visual and/or audio indicators for showing whether or not the ball has struck a boundary line at a particular location.

In contrast to the above-mentioned known methods, systems and apparatuses, U.S. Pat. No. 4,199,141 is directed to a baseball pitching scoring apparatus as an instructional and amusement device for teaching the art of correctly pitching a baseball. The purpose of this known apparatus is more in line with the object of the present invention.

On the above background the apparatus of the present invention takes as a starting point a sheet or mat forming a target surface and having embedded therein a is plurality of pressure sensitive electrical switches distributed over the target surface and connected to electronic circuitry for outputting, processing and displaying electrical signals from pressure sensitive switches when activated by impact or pressure of a moveable object, such as a ball.

What is novel and specific to the apparatus according to the invention is given in the independent claim.

Two different possible structures having the same purpose will be described below.

The sheet or mat in a first embodiment of the apparatus according to the invention comprises an outer layer provided with a pattern of electrically conductive elements at least corresponding to a desired detection accuracy. This pattern of electrically conductive elements is subdivided into a number of individual zones, a characteristic feature of the invention. The inner part of the sheet or mat is provided with a second pattern for example in the shape of a conductive layer/film separated from the electrically conductive elements by means of an insulation layer having a particular shape. Thus, with the help of the electrically conductive elements and the conductive layer/film a plurality of pressure sensitive switches is created. The degree of detection accuracy is determined by the insulation layer applied between the upper/outer layer and the inner layer. The insulation layer is particularly shaped in order to ensure/secure a reliable and safe detection. The insulation layer can be applied in liquid form by way of for example silk screen printing method. It should also be mentioned that opposite construction, where the electrically conductive elements are placed on the inner layer and a conductive layer/film on the outer layer, is possible.

The first pattern of electrically conductive elements and the second pattern of electrically conductive elements are arranged or placed in such a way that they would be able to cooperate with each other.

Factors that make this construction special are the design/shape, the function and the applying of the insulation layer, together with its properties, and that the insulation layer is functioning/serving both as an insulation layer and as an intermediate layer, especially for example an adhesive layer/film, between the outer and the inner layer. On the other hand the insulation layer determines the degree of detection accuracy. All this provides for a very reliable indication of the position of impact of the object concerned.

The electronic circuitry involved may comprise a computer or microprocessors provided with suitable software so as to obtain a type of display or presentation being favourable to the training or practicing situation of the player in the sport discipline concerned. At the same time the sheet or mat can be made to withstand/resist wear and tear during a long lifetime. To the sheet or mat can also be applied surface structure giving friction values corresponding to a desired type of field.

An additional advantage is that the complete apparatus for various purposes, can be portable/transportable, thus increasing the practical usefulness and value thereof.

The sheet or mat in a second embodiment of the apparatus according to the invention comprises: an outer layer which can be provided with a hollow and flexible dome-shaped protrusion at the position of each of the pressure sensitive switches formed by means of electrically conductive elements, where the internal surface of the outer layer is provided with a first pattern of electrically conductive elements at least at the positions of the pressure sensitive switches; and an inner layer of the sheet or mat which can be provided with a second pattern of electrically conductive elements at least at the positions of the pressure sensitive switches, where at least one of the first and the second pattern of electrically conductive elements is subdivided into a number of individual zones, each zone comprising a plurality of protrusions and pressure sensitive switches, with the electronic circuitry having separate connections to each of the individual zones. In addition the outer layer and the inner layer are separated from each other by means of an insulation layer having a particular shape, which insulation layer can serve as an adhesive layer.

A factor of importance in this connection is that the novel and specific form of the laminated sheet or mat comprising flexible protrusions and pressure sensitive switches provides for a very reliable indication of the position of impact of the object concerned.

Additional features according to the present invention are given in the dependent claims that contribute additionally to the advantages obtained.

Figure 3:
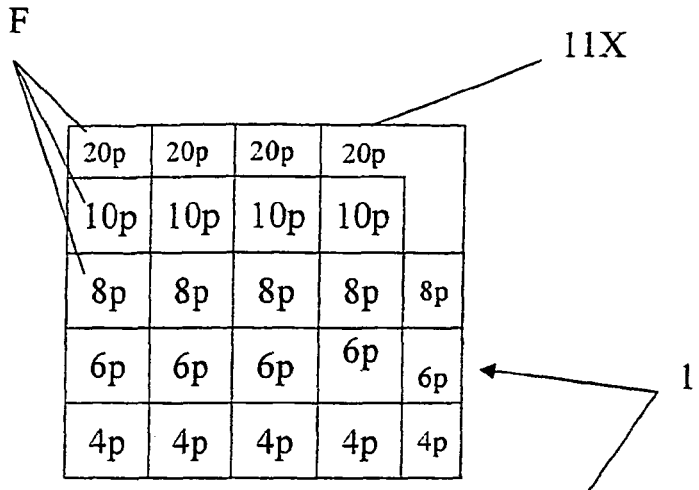
Figure 2:
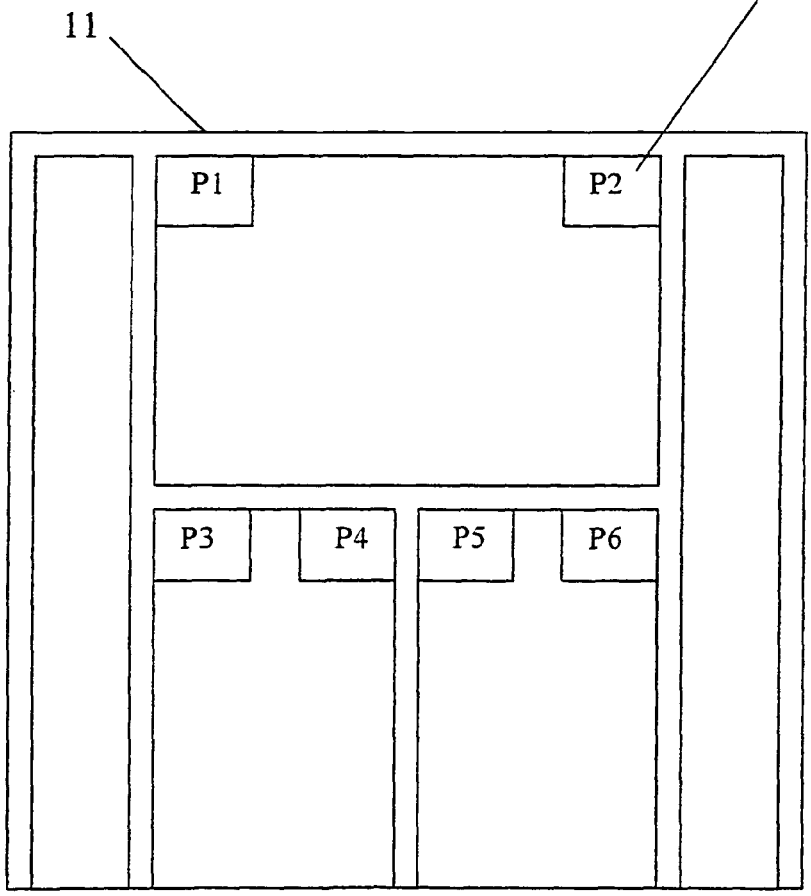
Figure 4A:
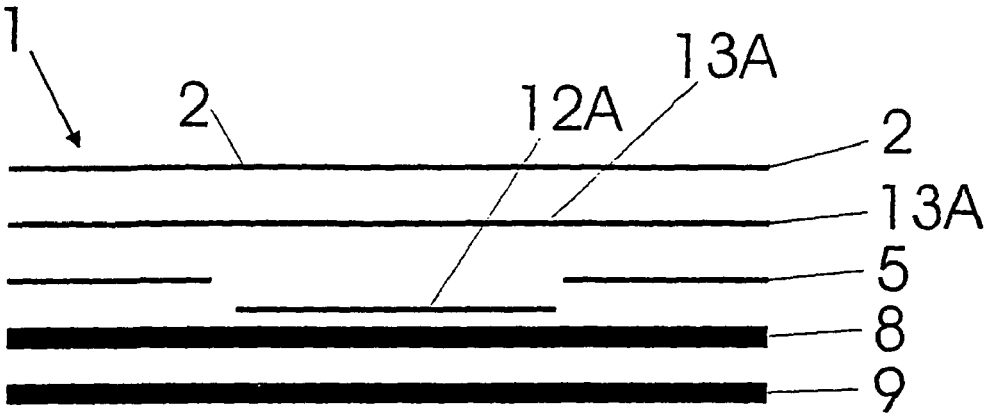
Figure 4B:
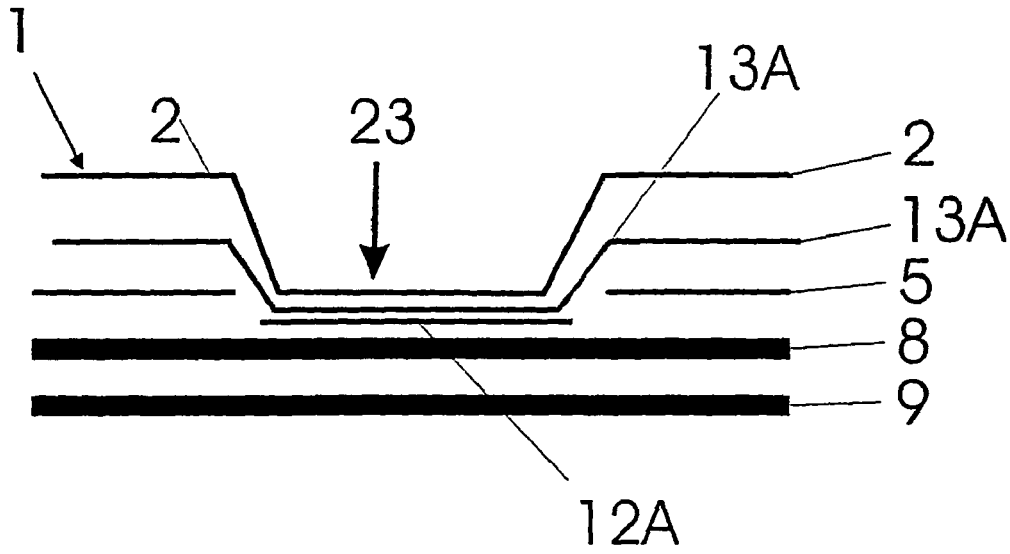
Figure 4C:
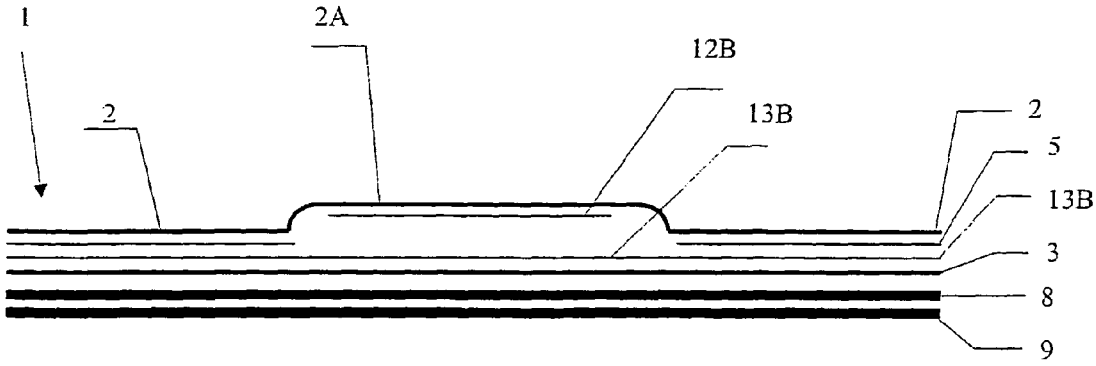
Figure 4D:
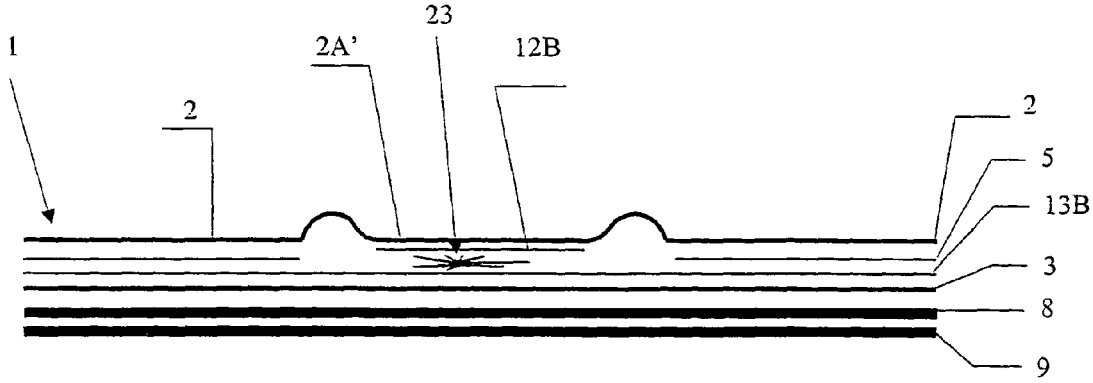
Figure 4E:
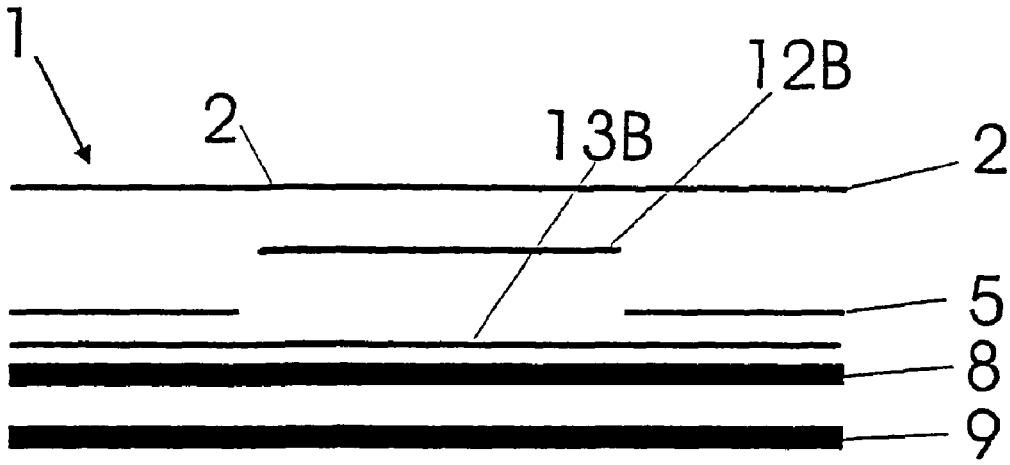
Figure 5A:
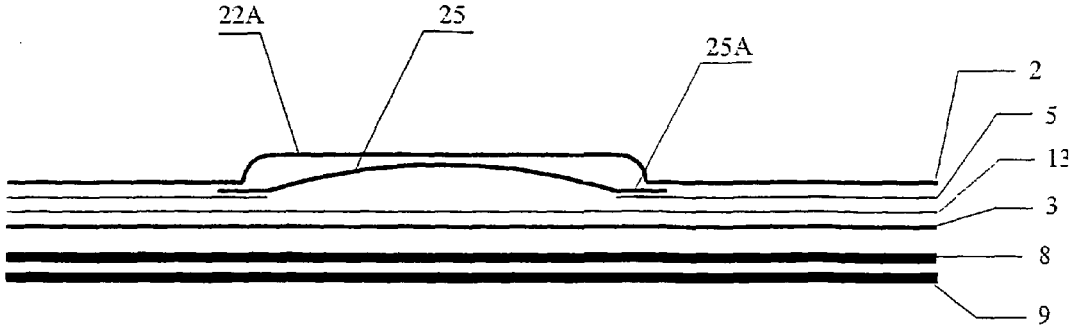
Figure 6:
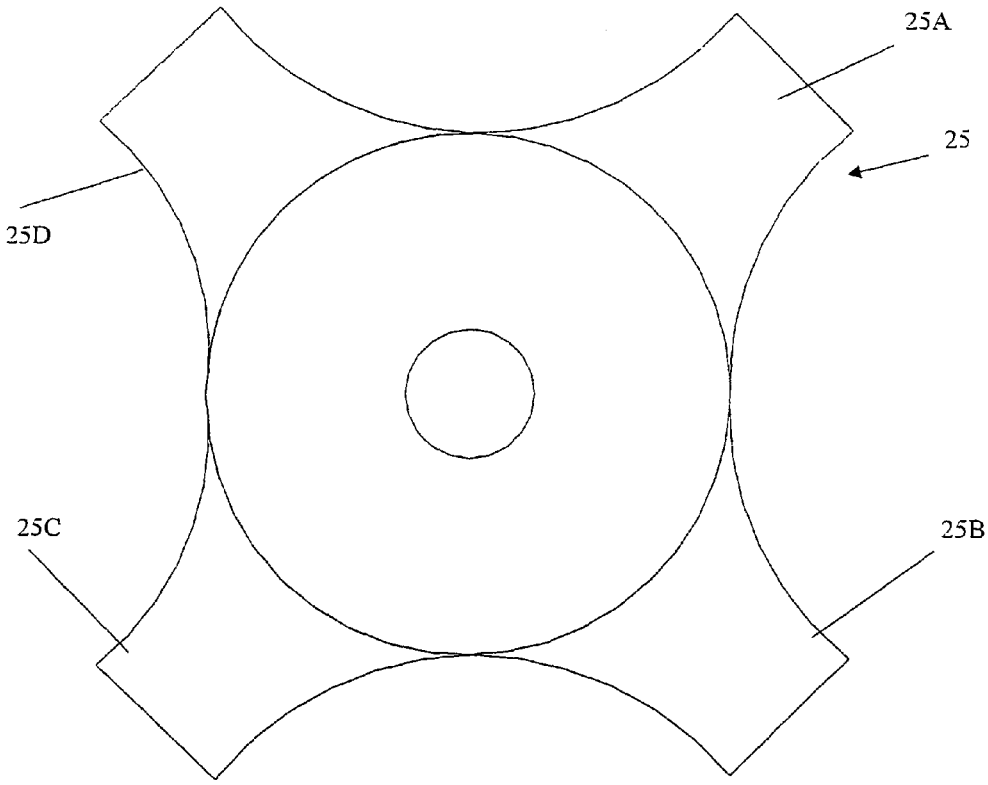
Figure 5B:
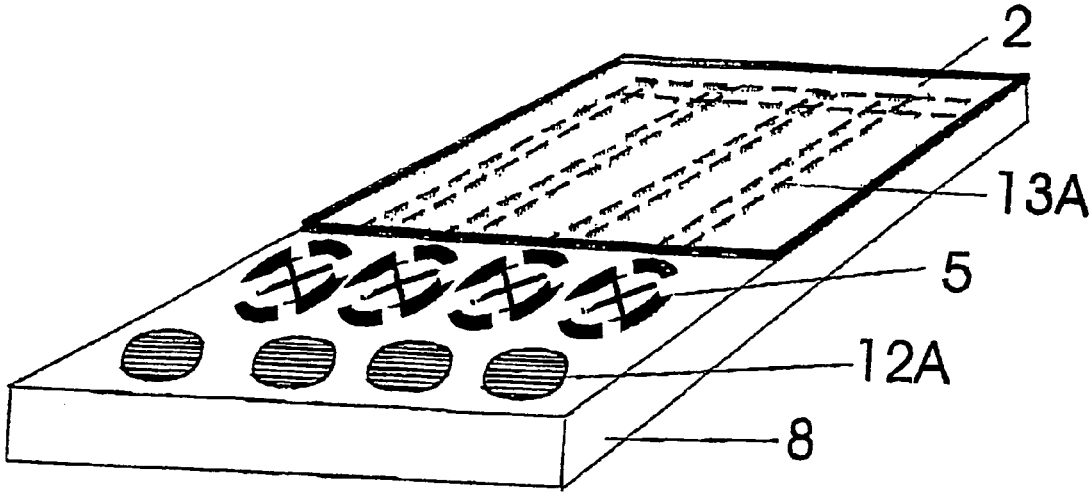
Figure 5C:
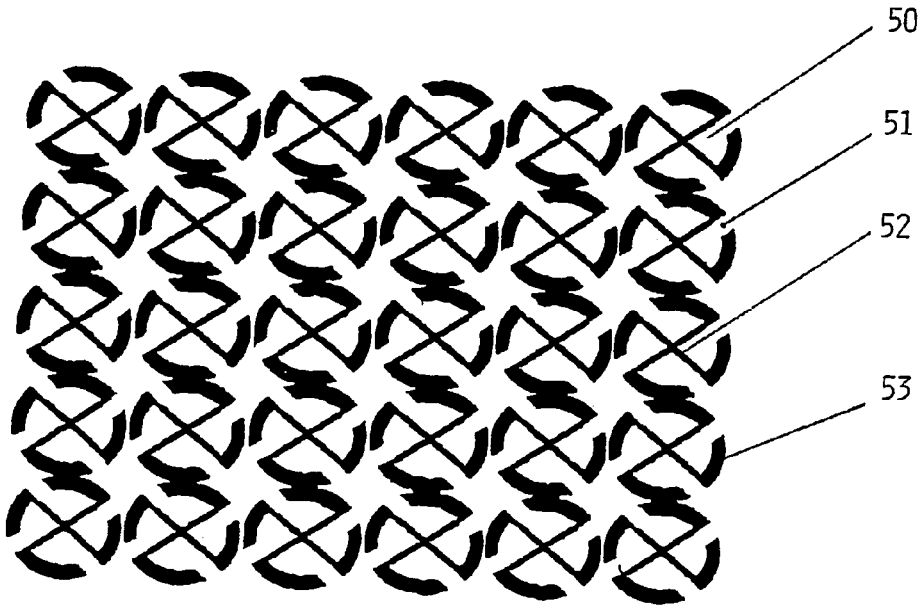
Figure 8:
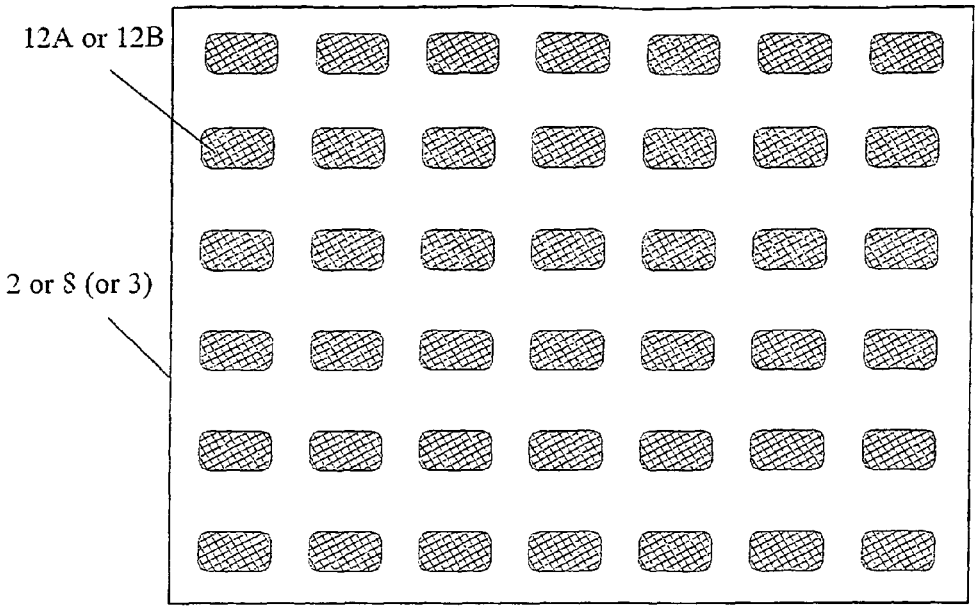
Figure 7:
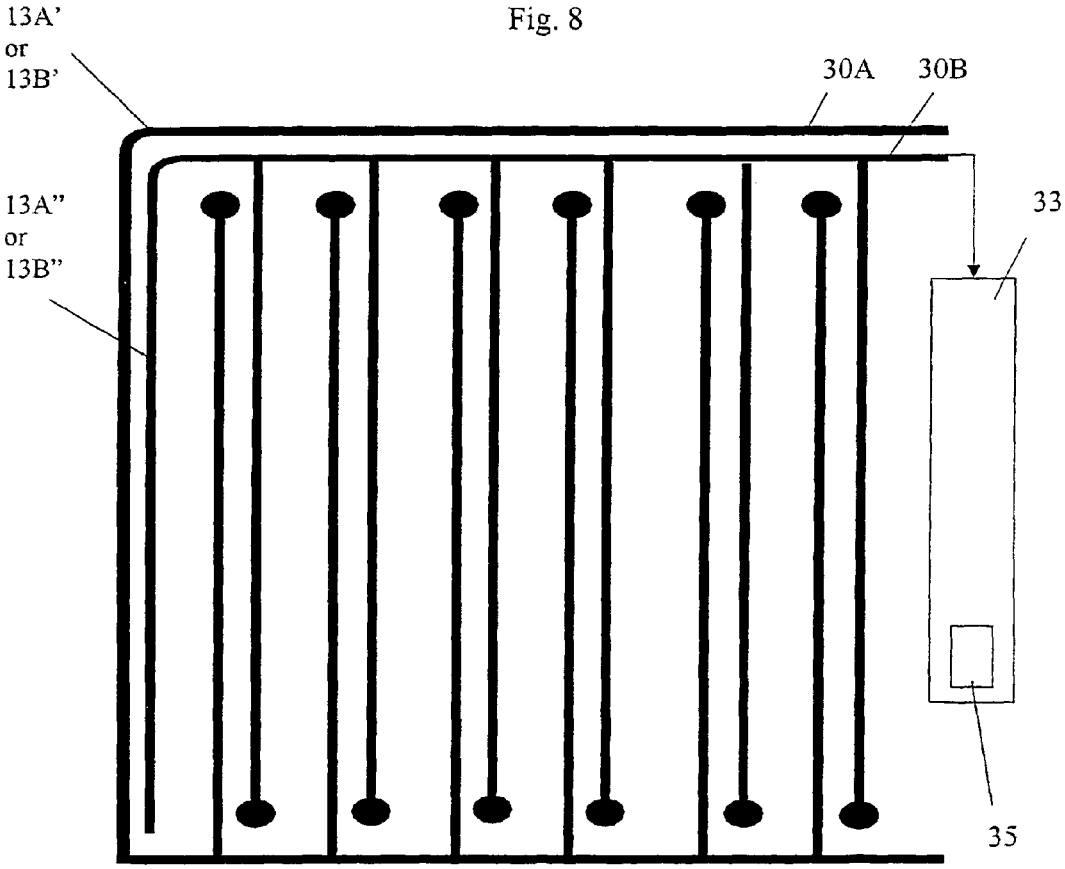
Figure 9:
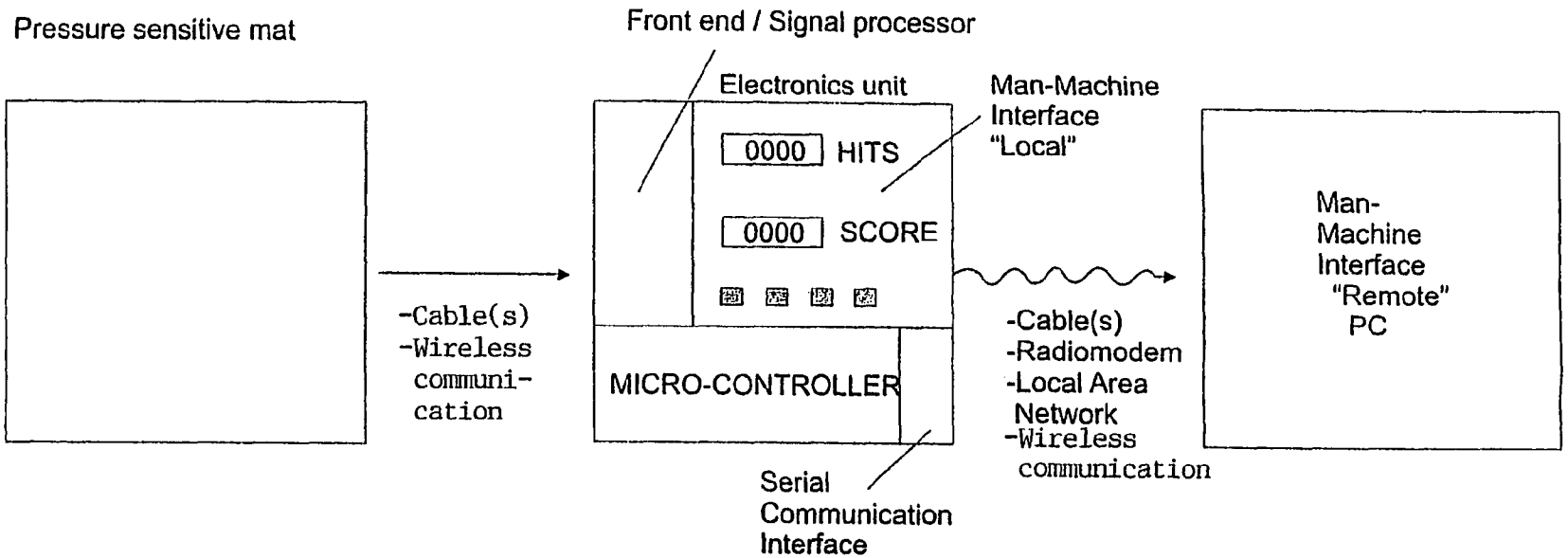

Embodiments of the apparatuses according to this invention will be further described below with reference to the drawings, where:

FIG. 1 in schematic elevation shows a target surface of an apparatus intended for use in baseball training and the like, FIG. 2 shows one half of a tennis court with various alternative locations of a tennis training mat according to this invention, FIG. 3 in more detail shows one of the training mats in FIG. 2, as subdivided into a number of separate zones, FIG. 4A in schematic cross-sectional view and at an enlarged scale, shows the laminated structure of a tennis training mat, having an adapted/adjusted insulation layer, which mat comprises electrically conductive elements, with the help of which a pressure sensitive switch is formed, FIG. 4B shows the elements of FIG. 4A in an activated or depressed state of the pressure sensitive switch in the laminated structure, FIG. 4C in schematic cross-sectional view and at an enlarged scale, shows the laminated structure of a tennis training mat, including one dome-shaped protrusion and electrically conductive elements, with the help of which a pressure sensitive switch is formed, FIG. 4D shows the elements of FIG. 4C in an activated or depressed state of the dome-shaped protrusion, FIG. 4E shows a construction of the tennis training mat according to the invention, resembling the one shown in FIG. 4A, but where the first and the second pattern of electrically conductive elements have changed places with each other, FIG. 5A is a cross-section similar to FIG. 4C, of a modified structure of the dome-shaped protrusion and electrical switch/element, FIG. 5B in perspective shows a cross-section similar to FIG. 4A, of the laminated mat structure according to the present invention, FIG. 5C shows a special design/shape of the insulation layer, FIG. 6 in plan view shows a spring element incorporated in the structure of FIG. 5A, FIG. 7 shows a typical pattern of conductors as applied to one layer of a sheet or mat in the apparatus of the invention, FIG. 8 shows a form of a pattern of electrically conductive elements for cooperation with the conductor pattern of FIG. 7, and FIG. 9 is an overall and partially block schematic illustration of a practical embodiment of an apparatus according to the invention.

The baseball training apparatus surface or sheet 10 in FIG. 1 is placed vertically on a prefabricated stand and is subdivided into a number of separate zones, of which some have been labelled A, B, C, D . . . , with a series of narrower zones along the edges of the surface, some of these narrower zones being labelled X, Y, Z . . . . At the lower right-hand corner one zone is shown with an arrangement of protrusions or switches 10A, 10B, 10C . . . to be described more in detail with reference to FIGS. 4A-6. It is to be understood of course, that such protrusion or switch functions are also provided in all the zones A, B, C, D . . . , as well as in zones X, Y, Z . . . in the target surface 10 shown in FIG. 1.

Although baseball training is considered to be of major interest in connection with the apparatus of the present invention, the embodiments to be described in the following description are related to a tennis training mat intended to give tennis players of almost every level of still, an aid to practice their precision of serve and shot/hit. Thus, in FIG. 2 there is indicated how a tennis training mat can be located at the positions of most interest for practicing tennis shots/hits, namely the mat positions P1, P2, . . . P6. The mat positions P3, P4, 25 and P6 are intended for serve shot training. The mat positions P1 and P2 are adjacent to the base line 11 of the tennis court, and are at the corners where tennis ball shots/hits are very often aimed by the player on the other side of the court. Tennis training mats according to the invention can also be placed at other locations on the tennis court/field. Reference numeral 1 indicates mat position P2 and FIG. 3 is an enlarged schematic view/illustration of this mat, showing a subdivision into a number of zones of which three have been indicated with reference letter F. In the larger or main zones an example of scoring points have been indicated, 4p, 6p, 8p and 10p, whereas marginal zones are provided with scoring indications 4p, 6p, 8p respectively 20p. It will be understood that the mat according to FIG. 3 will be positioned so that the border line 11X thereof will coincide with the base line 11. Accordingly, the top score of 20p is obtained when the ball hits the base line 11/11X. It is also possible to set/program the zones in a different way, so that the scoring indications would be different, for example all marginal/border zones can be provided with scoring indication 20p. Each scoring indication for every single zone can be varied as desired.

As in the embodiment of FIG. 1, each of the separate zones F in FIG. 3 will have a plurality of hollow and flexible, dome-shaped protrusions and pressure sensitive switches similar to FIGS. 4C and 4D, or only a plurality of pressure sensitive switches similar to FIGS. 4A, 4B and 4E, for example in a pattern or arrangement as shown at 10A, 10B, 10C . . . in FIG. 1.

In the mat structure 1 according to the first embodiment the applied insulation layer/adhesive 5 creates a given insulation distance between the electrically conductive pattern 13A on the underside of the outer or front layer 2 and the electrically conductive element 12A on the upper side of the inner layer 8 as in FIGS. 4A and 4B. This insulation layer/adhesive 5 is designed/applied to ensure that when not activated there is no contact between the electrically conductive elements 12A and 13A. When activated by impact or pressure 23 of a tennis ball or other desired object the outer layer 2 is pressed down towards the inner layer 8 and the electrically conductive elements 12A and 13A get into contact (FIG. 4B). The design/shape of the insulation layer/the adhesive layer 5 (as for example the distance between the holes (perforations) in the pattern, etc.), properties (as for example rigidness, flexibility, etc.) and dimensions (as for example thickness, etc.) determine the sensitivity of the mat 1, i.e. where a great force is necessary in order to establish contact/cooperation between the conductive electrical elements 12A and 13A. The materials used in the outer or front layer 2 have a given flexibility/rigidness in order to achieve a stable functioning. For this purpose there can be used for example a PVC or polycarbonate having a thickness of around 0.250-0.350 mm. As inner layer 8 there can be used a hard plate/sheet of PVC, polycarbonate or the like having a thickness of around 1.5-3.5 mm (preferably around 2.0-3.5 mm) in order to achieve a given rigidness and which at the same time functions as a supporting plate. On the underside of this plate/sheet 8 there is also applied a coating 9 of foamed PVC for an anti-slip purposes. The conductive electrical elements 12A and 13A can preferably be applied as a printed silver paste. The insulation layer/the adhesive layer 5 can be of an ultraviolet (UV) hardening or water-based or solution-based adhesive material and can be applied by way of for example printing technique with a typical thickness of about 0.03-0.06 mm. If a thicker insulation layer is desired an insulator which is pressible or compressible, can be used together with an adhesive in order to adhere together the outer and the inner layer. To this mat structure can also be applied a friction layer on top in order to get an approximate friction quotient as a tennis court surface. The thickness of this structure will vary in relation to desired friction. The figure and thickness outlined by the insulation layer/adhesive 5 must be adapted to the thickness of the friction layer since this affects the elasticity of the front or outer layer 2.

In FIG. 4E a construction of the tennis training mat 1 according to the invention is shown, which is similar to the one shown in FIGS. 4A and 4B, but where the first and the second pattern of electrically conductive elements 12B and 13B have changed places with each other. The underside of the outer layer 2 is provided with a pattern of electrically conductive elements 12B at least corresponding to a desired detection accuracy. This pattern of electrically conductive elements 12B is divided into a number of individual zones. The top or upper side of the inner part 8 of the sheet or mat 1 is provided with a second pattern in the shape of a conductive layer/film 13B which is separated from the electrically conductive elements 12B by means of an insulation layer 5 having a particular shape. Thus, with the help of the electrically conductive elements 12B and the conductive layer/film 13B a plurality of pressure sensitive switches is created. The degree of detection accuracy is determined by the insulation layer 5 applied between the upper or outer layer 2 and the inner layer 8.

The main components or parts in the laminated mat structure 1 illustrated in FIGS. 4C and 4D are an outer or front layer 2 and an inner supporting layer 3, which layers are being joined along most of their interface by means of an insulation layer/adhesive (substance) 5. It is to be noted that the adhesive layer 5 is not present at the points or positions where the outer layer 2 has a dome-shaped protrusion 2A, corresponding to protrusions 10A, 10B, 10C . . . shown in FIG. 1, or at the areas or positions where the desired contact between the upper/outer layer 2 and the inner layer 8 is to be achieved in an impact area for the mat structure 1 according to the first embodiment.

In the mat structure 1 according to the second embodiment, shown in FIGS. 4C and 4D, protrusion 2A forms a hollow space on the underside of layer 2 and is flexible so that it can be depressed (pressed down) by impact or pressure 23 of a tennis ball or other object contacting the mat 1 with a certain minimum force. In this embodiment the dimensions and material in the layer 2 are selected so as to make the protrusion 2A flexible for being subjected to elastic deformation when an impact or hit 23 occurs (FIG. 4D). On the underside of the protrusion 2A there is applied an electrically conductive element 12B adapted to cooperate with electrically conductive elements 13B applied to the upwardly facing surface of the inner supporting layer 3, in some embodiments directly on the inner layer lag 8.

In the situation illustrated in FIG. 4D protrusion 2A has been depressed to assume a shape as indicated at/by 2A', for example by impact or pressure 23 of a tennis ball. It is to be understood that immediately after such impact or pressure the protrusion will flex upwards and return to its normal, inactivated shape 2A as illustrated in FIG. 4C. In the depressed state as shown in FIG. 4D, an electrical contact is established (shown as a little spot) between the elements 12B and 13B, which makes it possible to generate an electrical signal, and the processing of this will be described below.

Layer 2 can for example be made of PVC, polycarbonate or the like which is 0.25 mm thick, with protrusions 2A being embossed to a height of 0.3-0.4 mm above the general level of layer 2. The supporting layer 3 can for example be made of polyester or the like with a thickness of around 0.125 mm and the intermediate adhesive layer 5 can be applied as a printed coating of about 0.025 mm thickness. The electrically conductive elements 12B and 13B can preferably be applied as a printed silver paste according to methods known per se, as for example employed for printed circuits in various other applications. Typical total dimensions of a tennis training mat 1 according to this invention, can be 1 meter square, but it is of course possible to use other shapes and dimensions, for example rectangular mats. It is much preferred that the conductive element 12B covers a central elevated portion of the inside of protrusion 2A, so as to secure a sufficient insulation or spacing from the conductive elements 13B in the normal or inactivated state of the protrusion 2A.

In order to support the structure described above, the tennis training mat 1 according to FIGS. 4C and 4D is provided with an inner supporting plate/sheet or layer 8, for example having a thickness of around 1.5-3.5 mm (preferably about 1.5-2.5 mm) and of PVC, polycarbonate or the like which on the underside has a coating 9 of foamed PVC for an anti-slip purposes. Usually such a laminated structure will have a preferred degree of flexibility, so as to have a stable position when laid on usual tennis court surfaces.

FIG. 5 shows a modified structure of the protrusion/switch design, where the inner and outer layers and supporting layer is as in FIGS. 4C and 4D. However, in the case of FIG. 5A there is integrated in protrusion 22A a spring element 2D being preferably of thin metal sheet and which can have a basic shape as shown in FIG. 6. Thus, spring element 25 has a more or less similar dome-shape as the protrusions 22A (and 2A), with tabs or feet 25A, 25B, 25C and 25D adapted to coincide with the adjoining flat portions of layer 2. With such spring type reinforcement of protrusion 22A, the requirements as to inherent flexibility/elasticity and deformation ability of the protrusion 22A as such formed in layer 2, are less severe. This also may be of interest in connection with increased impact forces that may occur in certain types of sports other than tennis. In cases of the latter types there may be applied a protective covering layer on top of outer layer 2. Also as shown in FIG. 5A a metal spring element 25 can constitute the electrically conductive element for cooperation with conductor elements 13B on the inner supporting layer 3.

The illustration of FIG. 5B is self-explanatory, showing in perspective a cross-section of the laminated mat structure, similar to FIGS. 4A (and 4B), according to the present invention. The applied insulation layer/adhesive layer 5 creates a given insulation distance between the electrically conductive pattern of conductive elements 13A applied on the underside of the front layer 2 and the electrically conductive elements 12A on the top or upper side of the inner layer 8. This insulation layer/adhesive layer 5 is designed/applied to ensure that when not activated there is no contact between the electrically conductive elements 12A and 13A. When activated by impact or pressure 23 of a tennis ball or other desired object the outer layer 2 is depressed towards the inner layer 8 and the electrically conductive elements 12A and 13A get into contact (FIG. 4B).

FIG. 5C shows a special design/shape of the insulation layer 5. In the insulation layer there is a hollow cavity/gap 50 in the desired contact areas between the two layers on each side of the insulation layer 5, so that the electrically conductive contact elements over and under the insulation layer 5 can get electrically connected. If the cavities/holes 50 in the insulation layer 5 are small, a great force is necessary in order to establish connection/contact between the electrically conductive elements. If the cavities/holes 50 in the insulation layer 5 are too big, a little force will be necessary in order to get the contact elements coupled. The size of the cavities/holes 50 is crucial for the desired sensitivity of the mat. The holes/cavities 50 in the insulation layer 5 will also determine the accuracy of the detection point in both longitudinal and lateral direction. The thickness of the isolation layer 5 is also important to the accuracy in order to be able to detect the hit point. The thicker the layer that is put on, the less sensitive the mat becomes. Other important features of this insulation layer 5 are that it has a special design/pattern, where the desired contact areas of the mat are partially surrounded 53 by the insulation which has at least one opening 51 sideways in relation to the two layers on each side of the insulation layer 5 and allowing the air between the layers in the desired contact areas to be pressed out from these areas through the opening(s) 51 when activated by impact or strong pressure 23, so that a good contact between the conducting elements on the outer layer and the conducting elements on the inner layer will be established, i.e. the pressure sensitive switches will be activated by impact or pressure 23. The insulation 53 which partially surrounds the desired contact areas can for example be ring-shaped, quadrangular or rectangular (rectangle-shaped) and with at least one sideways opening. Other shapes and forms are also possible (as for example rounded rectangle). The insulation layer 5 has one or several portions/sections 52 in the contact areas between the two layers making sure that contact between the conductive elements on the outer layer and the conductive elements on the inner layer can be established only by impact or by strong pressure 23, i.e. the pressure sensitive switches will be activated only by impact or by strong pressure 23. In the embodiment shown in FIG. 5C these portions have an "X" or "+" form/shape. Other shapes of these portions are also possible.

An important embodiment, such as for a tennis training mat, is illustrated in FIGS. 7 and 8. FIG. 7 in some detail shows the pattern of electrically conductive elements generally denoted by 13A or 13B in FIGS. 4A-4E and 5A-5B, where the elements 13B can be applied on the inner layer (FIGS. 4C-4E) or correspondingly the elements 13A can lie on the underside of the front or outer foil or layer 2 (FIGS. 4A-4B and 5B). FIG. 8 shows how an array of electrically conductive elements 12A or 12B can be arranged on the underside of layer 2 (12B on FIGS. 4C-4E) or correspondingly can be placed on the inner layer (12A on FIGS. 4A-4B and 5B), i.e. for example at the positions of protrusion 2A (in some embodiments) or at the desired contact areas of the mat, as explained above. Pairs of conductors running in parallel as shown in FIG. 7 by 13A' and 13A" for the mat construction according to FIGS. 4A-4B and 5B, and by 13B' and 13B" for the mat construction according to FIGS. 4C-4E and 5A, and in operation having applied thereto different voltages, may be short-circuited when contact with conducting elements 12A, 12B or 25 is established by an impact or pressure, so that contact between both parallel conductors 13A' and 13A", respectively 13B' and 13B", is established. This arrangement of elements in the pressure sensitive switches is very advantageous, and can be manufactured conveniently by deposition/applying of electrically conductive coatings/paste, as employed for example in printed circuit technology. The arrangement of conductive elements as shown in FIGS. 7 and 8 can be representative of one separate zone as described above in connection with FIGS. 1 and 3. Accordingly it is preferred that each such zone contains a plurality of contact surfaces/areas or in some embodiments protrusions and corresponding conductive elements/switches, for example 42 pieces (6 rows×7 columns) as evident from FIG. 8. From FIG. 7 it will also be seen that all switches in one zone may be electrically connected/coupled in parallel, so that the individual zone is actually defined in this way.

FIG. 7 also shows very schematically how electrical output signals or pulses from the zone switches are delivered through common conductors 30A and 30B as input to electronic circuitry generally indicated at 33. It will be understood that electronics block 33 is connected to several or all of the zones comprised by one sheet or mat, for receiving and processing signals from the zones, thus making possible the presentation of complete and adequate information to the user. The communication between the conductors 30A and 30B and the electronic circuitry or block 33 can be done by means of one or several cables or wireless.

The electronic circuitry or block 33 as indicated in FIG. 7, can comprise a displaying device or screen 35, and in actual practice a standard PC can constitute the whole or most of the electronic circuitry required for processing and displaying training results in the desired manner. Of course the displaying device 35 can be a separate unit, for example for placement at a convenient location for the player during practice or training. In this case the communication between the electronic circuitry 33 and the displaying device 35 can be done by means of one or several or wireless. The electronic circuitry or block 33 can also in some embodiments preferably be divided into two or more packages or boxes, including electronic circuitry parts to be integrated in the sheet or mat itself. With present-day technology there will be no problem in having such circuitry parts or packages mounted or embedded in a mat of practical dimensions. Moreover, methods of signal or pulse outputting, as well as processing and displaying for different uses of this apparatus, will be quite straightforward to professionals in the fields concerned, such as programmers for microprocessors or a computer incorporated in the electronic circuitry generally denoted by reference numeral 33 in FIG. 7. In this respect reference can be made to signal processing described in some of the US patent specifications referred to in the introductory part of the present description.

In actual practice the training mat as described here can be connected to a Windows-based PC of some sort, portable or stationary, through a standard cable or via wireless technology. The software concerned will interpret the signals from the mat as well as provide a user-friendly interface. In the example of FIG. 2 six possible placements of the mat on one half of a tennis court are indicated. Software as just mentioned should treat the signals from the mat differently depending on which of these six positions the mat is located in. In other words the scoring system (see indications of available scoring points in FIG. 3) is based on the position of the mat. As one possible feature to be incorporated in the software required, an impact or ball hit on more than one mat zone simultaneously, shall only be registered as a hit in the zone having the best score of the ones hit, or vice versa.

The illustration of FIG. 9 is self-explanatory, showing a sheet or mat 1, electronic circuitry 33 and displaying device 35 corresponding to indications in FIG. 7.

In a tennis training mat as described above and in these sheets or mats in general, the distribution of the first and/or the second pattern of electrically conductive elements is designed to let at least one switch be activated or depressed by impact or pressure of a tennis ball or other movable object to be detected. However, the spacing between the electrically conductive elements can also be selected so as to make possible activation of at least two, three or four electrical switches at the impact or pressure of a tennis ball or other movable object. For example, in a special embodiment of the mat, the basic shape of protrusion 2A is circular with a diameter of 14 mm and a spacing centre to centre of 18 mm. However, the profile does not necessarily have to be dome-shaped as mentioned above, and in other embodiments according to the invention the mat or sheet is entirely flat.

If it is desired that the insulation layer between the two patterns of electrically conductive elements will not allow contact between them, a different electrical property, as for example capacity, etc., can be measured so that it would be possible to detect an impact or pressure of a ball or other desired object.

While the foregoing disclosure is directed to the preferred embodiments of the invention, various modifications will be apparent to those skilled in the art. It is intended that all variations within the scope and spirit of the appended claims will be embraced by the foregoing disclosure.

The invention claimed is:

1. Device to use in sports and games for detecting the position of impact of a moveable object, comprising:

a sheet or mat with an outer layer and an inner layer, the sheet or mat forming a target surface;

a plurality of electrically conductive elements embedded in the sheet or mat and forming pressure sensitive switches distributed over the target surface and communicating with electronic circuits for outputting, processing and displaying electrical signals from pressure sensitive switches when activated by said impact or pressure, wherein the plurality of electrically conductive elements comprise a first pattern of electrically conductive elements provided at an underneath side of the outer layer of the sheet or mat at least at the positions of the pressure sensitive switches, and a second pattern of electrically conductive elements provided at an upper side of the inner layer of said sheet or mat at least at the positions of the pressure sensitive switches, the first pattern of electrically conductive elements and the second pattern of electrically conductive elements being arranged so as to enable temporary contact to be established at the positions of the pressure sensitive switches, and an insulation layer between said outer and inner layers is provided with cavities or holes at the positions of the pressure sensitive switches for establishing temporary contact therein, and from each cavity or hole at least one opening directed sideways for air movement during said impact or pressure activation, and wherein at least one of the first and second patterns of electrically conductive elements is subdivided into a number of individual zones, where each zone comprises a plurality of said pressure sensitive switches, and the electronic circuits have separate connections to each of said individual zones.

2. The device according to claim 1, wherein one of a character and a thickness of the insulation layer determines the detection sensitivity.

3. The device according to claim 1, wherein the second pattern of electrically conductive elements is applied on an upward surface of an inner support layer joined with the inner layer.

4. The device according to claim 1, configured for use with a ball, having a given size, wherein said positions of the pressure sensitive switches are mutually spaced in such a way that the ball by impact or pressure will activate at least two pressure sensitive switches.

5. The device according to claim 1, wherein at least one of said first pattern of electrically conductive elements and said second pattern of electrically conductive elements is formed by printed circuit elements.

6. The device according to claim 1, wherein the outer layer of the sheet or mat is further provided with a hollow and flexible, dome-shaped protrusion at each position of the pressure sensitive switches, each zone comprising a number of protrusions.

7. The device according to claim 6, wherein said hollow and flexible protrusions provide a sufficient degree of elastic deformation when activated by said impact or pressure, which also affects the degree of detection accuracy.

8. The device according to claim 6, wherein said hollow and flexible protrusions are further provided with spring elements for obtaining a sufficient degree of elastic deformation when activated by said impact or pressure.

9. The device according to claim 6, wherein the shape of said protrusions is substantially circular as seen in plan view.

10. The device according to claim 1, wherein the surface of the sheet or mat is provided with at least one line corresponding to a line that is to be found on a standard field or court for the sport or game concerned, where at least some of the zones border said at least one line.

11. The device according to claim 10, wherein said at least one line, located or provided on said surface, contains line zones having pressure sensitive switches, preferably with said line zones arranged in the longitudinal direction of said at least one line.

12. The device according to claim 2, wherein the second pattern of electrically conductive elements is applied on an upward surface of an inner support layer joined with the inner layer.

13. The device according to claim 2, configured for use with a ball, having a given size, wherein said positions of the pressure sensitive switches are mutually spaced in such a way that the ball or the object by impact or pressure will activate at least two pressure sensitive switches.

14. The device according to claim 3, configured for use with a ball, having a given size, wherein said positions of the pressure sensitive switches are mutually spaced in such a way that the ball or the object by impact or pressure will activate at least two pressure sensitive switches.

15. The device according to claim 2, wherein at least one of said first pattern of electrically conductive elements and said second pattern of electrically conductive elements is formed by printed circuit elements.

16. The device according to claim 3, wherein at least one of said first and pattern of electrically conductive elements and said second pattern of electrically conductive elements is formed by printed circuit elements.

17. The device according to claim 4, wherein at least one of said first pattern of electrically conductive elements and said second pattern of electrically conductive elements is formed by printed circuit elements.

18. The device according to claim 2, wherein the outer layer of the sheet or mat is further provided with a hollow and flexible, dome-shaped protrusion at each position of the pressure sensitive switches, each zone comprising a number of protrusions.

19. The device according to claim 3, wherein the outer layer of the sheet or mat is further provided with a hollow and flexible, dome-shaped protrusion at each position of the pressure sensitive switches, each zone comprising a number of protrusions.

20. The device according to claim 4, wherein the outer layer of the sheet or mat is further provided with a hollow and flexible, dome-shaped protrusion at each position of the pressure sensitive switches, each zone comprising a number of protrusions.

21. The device according to claim 5, wherein the outer layer of the sheet or mat is further provided with a hollow and flexible, dome-shaped protrusion at each position of the pressure sensitive switches, each zone comprising a number of protrusions.

22. The device according to claim 7, wherein said hollow and flexible protrusions are further provided with spring elements for obtaining a sufficient degree of elastic deformation when activated by said impact or pressure.

23. The device according to claim 7, wherein the shape of said protrusions is substantially circular as seen in plan view.

24. The device according to claim 8, wherein the shape of said protrusions is substantially circular as seen in plan view.

25. The device according to claim 2, wherein the surface of the sheet or mat is provided with at least one line corresponding to a line that is to be found on a standard field or court for the sport or game concerned, where at least some of the zones border said at least one line.

26. The device according to claim 3, wherein the surface of the sheet or mat is provided with at least one line corresponding to a line that is to be found on a standard field or court for the sport or game concerned, where at least some of the zones border said at least one line.

27. The device according to claim 4, wherein the surface of the sheet or mat is provided with at least one line corresponding to a line that is to be found on a standard field or court for the sport or game concerned, where at least some of the zones border said at least one line.

28. The device according to claim 5, wherein the surface of the sheet or mat is provided with at least one line corresponding to a line that is to be found on a standard field or court for the sport or game concerned, where at least some of the zones border said at least one line.

29. The device according to claim 6, wherein the surface of the sheet or mat is provided with at least one line corresponding to a line that is to be found on a standard field or court for the sport or game concerned, where at least some of the zones border said at least one line.

30. The device according to claim 7, wherein the surface of the sheet or mat is provided with at least one line corresponding to a line that is to be found on a standard field or court for the sport or game concerned, where at least some of the zones border said at least one line.

31. A device to use in sports and games for detecting the position of impact of a moveable object, comprising:

a sheet or mat with an outer and an inner laver, the sheet or mat forming a target surface;

a plurality of electrically conductive elements embedded in the sheet or mat and forming pressure sensitive switches distributed over the target surface and communicating with electronic circuits for outputting, processing and displaying electrical signals from pressure sensitive switches when activated by said impact or pressure, wherein the plurality of electrically conductive elements comprise a first pattern of electrically conductive elements provided at an underneath side of the outer layer of the sheet or mat at least at the positions of the pressure sensitive switches, and a second pattern of electrically conductive elements provided at an upper side of the inner layer of said sheet or mat at least at the positions of the pressure sensitive switches, and the first pattern of electrically conductive elements and the second pattern of electrically conductive elements being arranged so as to enable temporary contact to be established at the positions of the pressure sensitive switches; and an insulation layer between said outer and inner layers is provided with cavities or holes at the positions of the pressure sensitive switches for establishing temporary contact therein, and from each cavity or hole at least one opening directed sideways for air movement during said impact or pressure activation, wherein at least one of the first and second patterns of electrically conductive elements is subdivided into a number of individual zones, where each zone comprises a plurality of said pressure sensitive switches, and the electronic circuits have separate connections to each of said individual zones, wherein the outer layer of the sheet or mat is further provided with a hollow and flexible dome-shaped protrusion at each position of the pressure sensitive switches, each zone comprising a number of protrusions, said hollow and flexible protrusions further including spring elements for obtaining a sufficient degree of elastic deformation when activated by said impact or pressure, and wherein the surface of the sheet or mat is provided with at least one line corresponding to a line that is to be found on a standard field or court for the sport or game concerned, where at least some of the zones border said at least one line.

32. The device according to claim 9, wherein the surface of the sheet or mat is provided with at least one line corresponding to a line that is to be found on a standard field or court for the sport or game concerned, where at least some of the zones border said at least one line.

* * * * *